United States Patent [19]

Moling

[11] 4,079,786

[45] Mar. 21, 1978

[54] FIRE EXTINGUISHING SYSTEM

[76] Inventor: LeRoy I. Moling, Rte. 3, Fergus Falls, Minn. 56537

[21] Appl. No.: 691,224

[22] Filed: Jun. 1, 1976

[51] Int. Cl.[2] ..... A62C 37/04

[52] U.S. Cl. ..... 169/61; 169/16; 239/209; 340/418

[58] Field of Search ..... 169/16, 60, 61, 19; 340/418; 239/208, 209

[56] References Cited

U.S. PATENT DOCUMENTS

| | | | |
|---|---|---|---|
| 605,611 | 6/1898 | McGeoch | 239/208 X |
| 690,372 | 12/1901 | Lloyd | 239/208 |
| 3,179,181 | 4/1965 | Banzato | 169/16 X |
| 3,865,192 | 2/1975 | Dunphy | 169/61 |
| 3,990,518 | 11/1976 | Hemme | 169/16 X |

FOREIGN PATENT DOCUMENTS

| | | | |
|---|---|---|---|
| 9,306 of | 1897 | United Kingdom | 239/209 |

*Primary Examiner*—Evon C. Blunk
*Assistant Examiner*—Michael Mar

[57] ABSTRACT

The invention herein relates to improvement in a fire extinguishing system which is arranged and constructed to cover a room area with a mist spray. The improvement herein consists in providing each room, as in a house, with a unitary ceiling perimeter molding, the molding being formed to have a passage therethrough, the room facing portion of said molding having small apertures therethrough to pass a mist spray of water into the room, a pressurized water supply running to said passage, a valve controlling said water supply running to said passage, and sensors opening said valve at a temperature indicating the presence of a fire and closing said valve at a temperature indicating the fire has been put out.

11 Claims, 6 Drawing Figures

FIG. 2
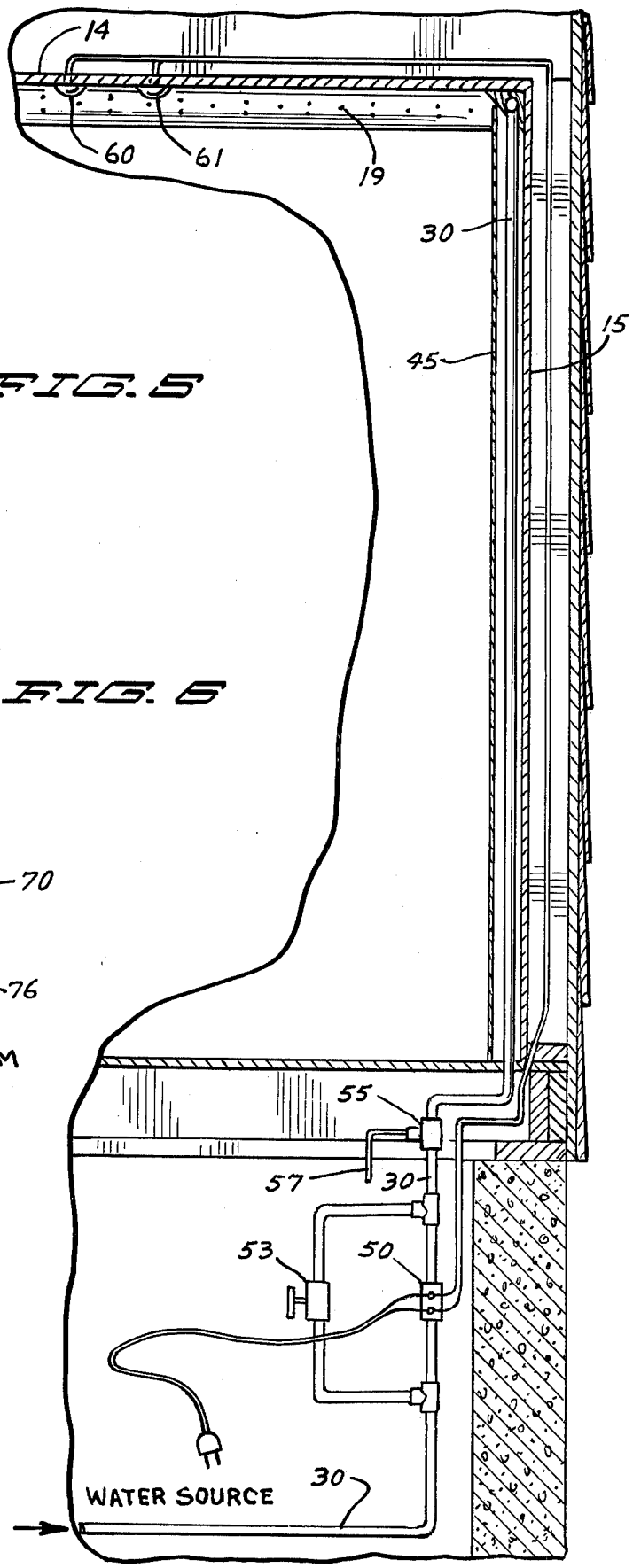
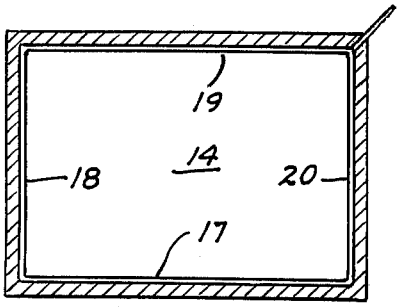
FIG. 5
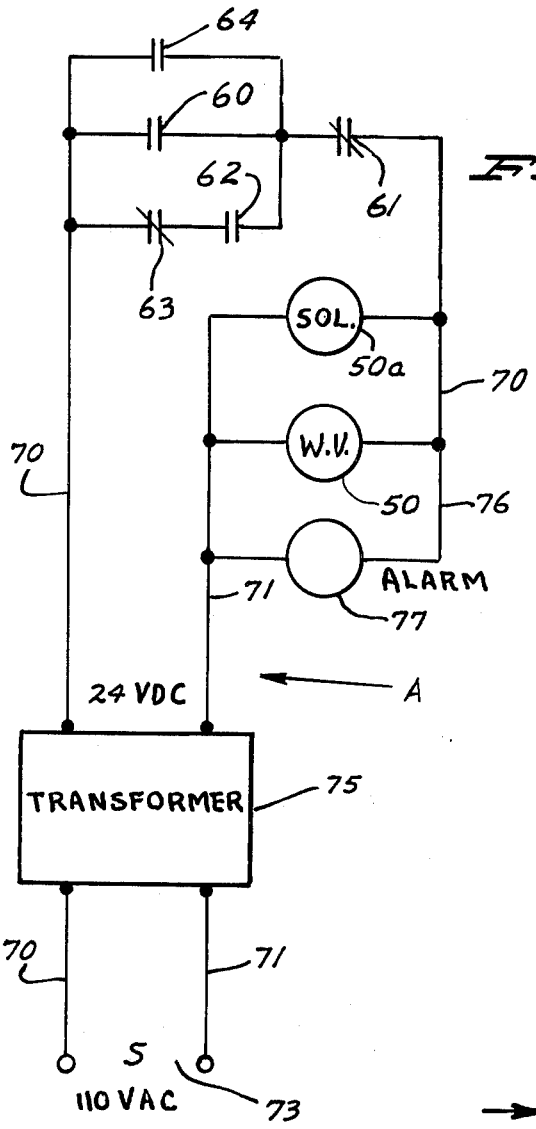
FIG. 6

FIRE EXTINGUISHING SYSTEM

BACKGROUND AND SUMMARY OF THE INVENTION

Automatically actuated fire extinguishing or sprinkler systems are in common use. It is also common practice to use sprinkling heads to apply water to a fire area. Here there is a concentration of water applied to the specific area covered by the sprinkler head. Frequently, more water than is required is applied and the application of water may continue for some time after the fire has been put out.

There is also known the use of apertured pipes which are ceiling mounted as disclosed in U.S. Pat. No. 3,892,277 to J. M. Curran and also known is the use of a roof ridge apertured pipe as disclosed in U.S. Pat. No. 1,620,142 to A. F. Thompson.

The invention as hereinafter described will be seen to have significant distinguishing differences.

It is one object of this invention to provide a fire extinguishing system in which the water delivering elements blend into the room structure as a part of the decorative appearance of the room.

It is another object of this invention herein to provide a sprinkling element in the form of a decorative molding about the perimeter of a ceiling of a room.

It is a further object of this invention to form a molding disposed about the perimeter of the ceiling of a room having a continuous passage therethrough and having in connection therewith a water supply.

It is also an object of this invention to provide a fire extinguishing system comprising a molding about the perimeter of the ceiling of a room, said molding having a passage therethrough and having its room facing portion apertured to pass a mist spray, a water supply running to said passage, a valve controlling said water supply to said passage and sensors opening said valve responsive to a temperature indicating a fire and closing said valve responsive to a temperature indicating that the fire has been extinguished.

These and other objects and advantages of the invention herein will be set forth in the following description made in connection with the accompanying drawings in which like reference characters refer to similar parts throughout the several views and in which:

FIG. 1 is a view in perspective with portions broken away showing an installation of the invention;

FIG. 5 is a plan view on a reduced scale with a portion broken away showing the invention comprising a perimeter molding; and FIG. 6 is a wiring diagram.

DESCRIPTION OF A PREFERRED EMBODIMENT

Figures 2, 3, 4:
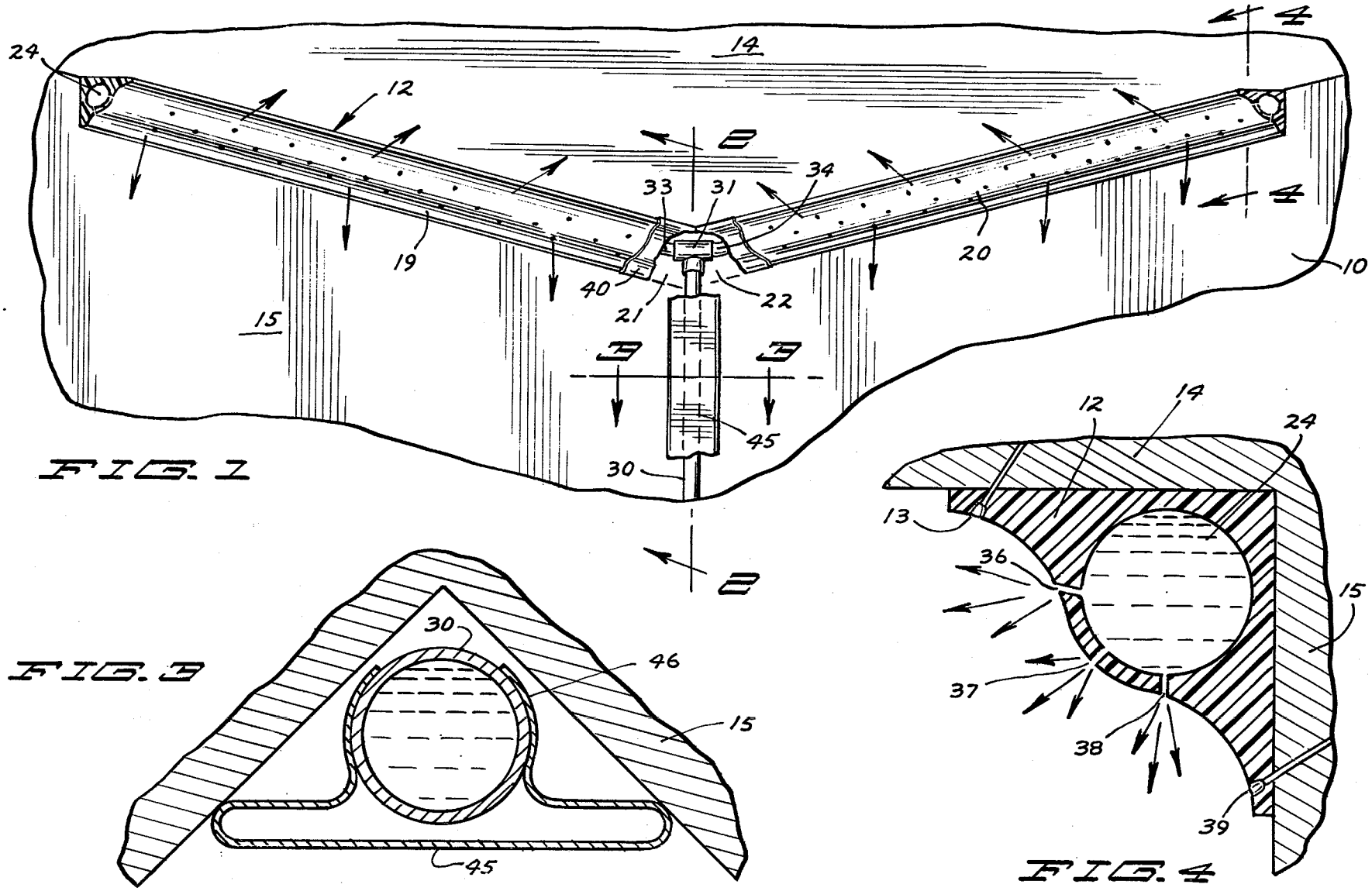
FIG. 2 is a view in vertical section as if taken on line 2—2 of FIG. 1 with a portion thereof being broken away showing a more complete installation of the invention herein.
FIG. 3 is a view in horizontal section taken on line 3—3 of FIG. 1 with a portion thereof being broken away.
FIG. 4 is a view in vertical section taken on line 4—4 of FIG. 1 as indicated.

Referring to the drawings, a room 10 is shown having installed therein a molding member 12 extending about the perimeter of the ceiling 14 at its juncture with its adjacent walls 15.

Said molding member is preferably formed of a suitable plastic material such as by extrusion and formed longitudinally through said molding is a passage 24. For convenience of handling, said molding member will be provided in suitable length sections such as sections 17, 18, 19, and 20. The passage through each section is indicated by said reference numeral 24.

Said sections 17–20 in forming said molding member 12 will have their abutting ends mitered and fused together in water tight connections by the use of a suitable adhesive.

A supply pipe riser member 30 is shown connected to a tee member 31 which in turn is here shown connected to elbow members 33 and 34 which are pressure fitted into the adjacent ends 21 and 22 of said sections 19 and 20 and which are shown in spaced relation for installation of said elbow and tee members.

All pipes and connecting members preferably are made of a suitable plastic material and connections are readily secured together by the use of a suitable adhesive.

The use of metal pipe such as copper tubing is also within the scope of the invention herein and if desired metal tubing may be disposed through the passage 24 but is not here thus shown.

The molding member 12 is here indicated as being substantially triangular in transverse section for installation into the angular space at the juncture of the walls 15 and ceiling 14 but it is to be understood that the molding member 12 will be made to conform to any given design requirement.

The outward or room facing wall portion 32 of said molding member 12 is shown having formed therethrough a plurality of apertures in spaced relation comprising apertures 35 which have their axes angled toward the ceiling of the room, apertures 37 which have their axes directed outwardly into the room area generally and apertures 38 which have their axes directed downwardly. Said apertures will have small bores such as on the order of 0.026 inches in diameter and which are not unlike pin holes. In the event that the metal tubing is disposed within the passage 24, said tubing will have apertures corresponding to the apertures 36–38.

The molding member 12 may be secured in position in various ways and is here shown secured by nails 39 driven through the solid edge portions of said molding member.

To cover the separation in the molding member 12 as at the spaced ends 21 and 22, a suitable cover plate member 40 which may be stamped out of metal or be formed of sheet plastic is provided and may have a pair of rearward extending fingers or clamp members, not here shown, to grip the pipe 30 or tee member 31. Said member 40 may also be secured by the use of a suitable adhesive.

The supply pipe 30 may be concealed within a wall but is surface mounted, as here indicated, a plate cover member 45 is provided having a rearward extending pipe clamping portion 46 adapted to embrace the pipe 30 to provide a decorative appearance. Said supply pipe will run to a suitable pressurized water supply or other extinguishant as may be desired.

The pipe 30 is shown in FIG. 2 as having mounted thereon an electric control valve member 50 of known design which will be further described.

Also mounted onto said pipe 30 is a line by-passing the valve member 50 and having a manually operable valve member 53 in connection therewith.

Carried by said pipe 30 downstream of said valves 50 and 53 is a drain tee 55 which will discharge through a small tube 57 to a suitable drain outlet.

Mounted in suitable locations, such as being ceiling mounted, will be sensor members or sensors 60 and 61 in a cooperative relation and these will be of such number as required and will be of conventional design to sense the presence of fire or smoke. Said sensor members are electrical switches on the order of thermostats.

The concept here is to provide for the use of dual sensors whereby when the ambient temperature is such as to be raised to the order of 105° F. to indicate the presence of fire, the sensor 60 will cause the valve 50 through the action of its solenoid **50*a* to become opened as will be further described in connection with the wiring diagram of FIG. 6 and when said temperature falls to the point to indicate that the fire has been put out such as on the order of 60° F, then the sensor 61 will cause the solenoid to become de-energized and valve member 50 to become closed. The solenoid 50*a* will normally maintain the water valve 50** in closed condition. Thus, a good deal of water damage is avoided by having the water supply turned off when no longer needed.

From the description given of the molding member 12, it will be noted that the water is applied in a mist or fine spray and that the spray is directionally emitted as indicated by the directional positioning of the apertures 36–38. The room area will receive a spray of water throughout without having strong streams of water applied as from a nozzle head.

With reference to FIG. 6, a wiring diagram is shown of a circuit A which as here shown includes lines 70 and 71 running from a current source 73 to a transformer 75 with the line 71 running therefrom to one side of the solenoid **50*a* of the water valve 50. The other line 70 runs from said transformer and includes the sensors 60 and 61 in running to the other side of said solenoid member 50*a***.

In circuit with said line 71 is a line 76 which includes an alarm 77 and this may be audible and/or visual. The alarm is of conventional design and though not here indicated, it may be shut off if desired.

The sensor 61 is normally closed at normal ambient temperatures such as in a comfort range above 60° F and is caused to open to break the circuit A by sensing a reduction from a temperature that would indicate the presence of a fire to a predetermined lower degree of temperature such as of 60° F or less following a fire being put out, this lower temperature is substantially lower than the normal ambient temperature due to the presence of the chilling effect of the water used to extinguish the fire.

The sensor 60 is normally open and in connection therewith and operating said sensor are the sensing elements 62, 63, and 64.

The sensing element 62 is characterized as a conventional heat sensing element responsive to a temperature such as of 105° F which will close the sensor 60 to complete circuit A upon sensing or detecting such a predetermined temperature such as to indicate the presence of fire.

The sensing element 64 is a smoke detection sensing element of a conventional design and is arranged to sense or detect a predetermined degree of smoke at which time it will close the sensor 60 and complete the circuit A. When the smoke has subsided to a sufficient predetermined degree, the sensing element 63 is arranged to sense the same and to cause the sensor 60 to open and to break the circuit A.

The circuit A upon being completed will cause the solenoid **50*a* to become energized and open the water valve 50 to permit the passage of water to the molding member 12**. Said water valve is normally closed.

When a fire has been put out, there will be a drop in temperature in the room lower than the otherwise room temperature due to the presence of water in the room. The water will be cold and will have a chilling effect and is here indicated as being 60° F or less. The sensor 61 will detect and respond to the fall in temperature at such a predetermined lowering of said temperature and will break the circuit A de-energizes the solenoid and the sensor 60 will become open when the temperature returns to a normal ambient temperature in a comfort range above 60° F, the sensor 61 will become closed which is its normal inoperative position.

Instead of using a broad band thermostat operating at 105° F at its high setting and at 60° F at its lower setting, there are here used two thermostats to control circuit A as described.

If the fire should start up again, the cycle of action above described will be repeated.

The manual valve 53 is provided in the event of a malfunction of the electrical system or if manual operation is otherwise desired.

It is seen that there has been provided a novel arrangement of a perimeter mold member as a sprinkler member and that in connection therewith is the novel arrangement for activating and deactivating the sprinkler system.

It will, of course, be understood that various changes may be made in the form, details, arrangement and proportions of the apparatus without deporting from the scope of applicant's invention which, generally stated, consists in an apparatus capable of carrying out the objects above set forth, in the parts and combination of parts disclosed and defined in the appended claims.

What is claimed is:

1. A fire sprinkling system for a room having in combination a unitary molding about the perimeter of the ceiling of a room, a passage through said molding, apertures in the room facing surface portion of said molding extending therethrough from said passage, a supply pipe running to said molding and communicating with said passage, a pressurized source of extinguishant communicating with said supply pipe, an electrical control valve in normally closed position in connection with said supply pipe controlling the passage of said extinguishant therethrough, a pair of cooperating sensor members in circuit with said control valve, and one of said sensor members causing the opening of said valve upon sensing a temperature indicating the presence of fire and the other of said sensor members causing the closing of said valve upon sensing the presence of a temperature indicating that the fire has been put out.

2. The structure set forth in claim 1, including a pipe line in communication with said supply line by-passing said control valve and having in connection therewith a manually operated valve.

3. The structure set forth in claim 1, including a drain member downstream of said control valve in connection with said supply line.

4. The structure set forth in claim 1, wherein said molding is formed to be an element of decoration within said room.

5. The structure set forth in claim 1, wherein said apertures in said molding are of such small size as to pass a fine mist spray therethrough.

6. The structure set forth in claim 1, including a decorative cover member overlying said supply pipe.

7. The structure set forth in claim 1, wherein a cover member overlies spaced end portions of said mold member.

8. The structure set forth in claim 1, wherein said one of said sensor members is normally in open position and said other of said sensor members is normally in closed position, and said one of said sensor members includes a heat sensing element actuating said sensor member to closed position to complete said circuit.

9. The structure set forth in claim 1, wherein said one of said sensor members is normally in open position and includes a pair of smoke detection sensing elements, one of said sensing elements closing said one of said sensor members upon sensing a predetermined degree of smoke, and the other of said sensing elements opening said one of said sensor members upon sensing that smoke has subsided to a certain predetermined degree subsequent to the detection of smoke by said first mentioned sensing element.

10. A fire sprinkling system for a room, having in combination a unitary molding about the perimeter of the ceiling of a room, a passage through said molding, apertures through the room-facing portion of said molding extending from said passage, a supply line running to said molding communicating with said passage, a pressurized source of extinguishant communicating with said supply line, an electrical valve in normally closed position in connection with said supply line controlling the passage of extinguishant therethrough, an electrical circuit including said control valve and including a pair of sensor members, one of said sensor members being in normally closed position, the other of said sensor members being in normally open position, said other sensor member becoming closed upon sensing a predetermined degree of heat such as to indicate the presence of fire and causing the said valve to open and allow the passage of extinguishant through said supply line to said passage in said molding, and said one of said sensor members becoming opened upon sensing a decrease in the degree of said heat to a predetermined lesser degree and thus causing said circuit to open and said valve to close.

11. The structure set forth in claim 1, wherein said other of said sensor members includes a pair of smoke detection sensing elements, one of said smoke sensing elements closing said other of said sensor members upon sensing a predetermined degree of smoke, and the other of said smoke sensing elements opening said one of said sensor members upon sensing a predetermined lesser degree of smoke whereby said electrical circuit is closed or opened respectively by the closing and opening of said other sensor member.

* * * * *